US008178806B2

(12) United States Patent
Rajauria et al.

(10) Patent No.: US 8,178,806 B2
(45) Date of Patent: May 15, 2012

(54) DEVICE FOR MOUNTING AN ACCESSORY DEVICE TO A CIRCUIT BREAKER

(75) Inventors: Samir Rajauria, Uttar Pradesh (IN); Lars Pommerencke, Neumunster (DE)

(73) Assignee: General Electric Company, Schenectady, NY (US)

( * ) Notice: Subject to any disclaimer, the term of this patent is extended or adjusted under 35 U.S.C. 154(b) by 502 days.

(21) Appl. No.: 12/425,443

(22) Filed: Apr. 17, 2009

(65) Prior Publication Data

US 2010/0264002 A1 Oct. 21, 2010

(51) Int. Cl.
*H01H 3/20* (2006.01)

(52) U.S. Cl. ..... 200/331

(58) Field of Classification Search ..... 200/331, 200/293, 400, 401; 403/120; 335/20, 14, 335/175

See application file for complete search history.

(56) References Cited

U.S. PATENT DOCUMENTS

| | | | | |
|---|---|---|---|---|
| 4,245,140 | A | 1/1981 | Jencks et al. | |
| 4,804,809 | A | 2/1989 | Thompson, Jr. et al. | |
| 5,302,786 | A * | 4/1994 | Rosen et al. | 200/400 |
| 5,477,016 | A | 12/1995 | Baginski et al. | |
| 6,072,132 | A * | 6/2000 | Turner | 200/330 |
| 6,495,781 | B2 * | 12/2002 | Greenberg et al. | 200/308 |
| 6,806,800 | B1 | 10/2004 | Castonguay et al. | |

* cited by examiner

*Primary Examiner* — Edwin A. Leon
(74) *Attorney, Agent, or Firm* — Global Patent Operation; Stephen G. Midgley

(57) ABSTRACT

A coupling between a motor operator and a circuit breaker includes a base plate of the motor operator having a top side and a bottom side, the base plate comprising an aperture, and a pin having a first end, the pin being captured within the aperture such that the first end of the pin protrudes through a first surface of the bottom side of the base plate, wherein the pin is further configured to engage the circuit breaker.

14 Claims, 5 Drawing Sheets

DEVICE FOR MOUNTING AN ACCESSORY DEVICE TO A CIRCUIT BREAKER

BACKGROUND

1. Field

The subject matter described herein relates generally to a motor operator for circuit breakers.

2. Related Art

It is known in the art to provide molded case circuit breakers for electrical systems. The circuit breaker is operative to disengage the electrical system under certain operating conditions. The use of accessories such as, for exemplary purposes only, motor operators to allow the motor-assisted operation of electrical circuit breakers is well known. The motor operator allows the circuit breaker to be operated remotely and to be opened, closed or reset after tripping of the circuit breaker.

The motor operator may be a field mountable device (e.g. an add on device) and is typically secured to the top of a circuit breaker housing. A lever within the motor operator mechanically interacts with a circuit breaker operating handle, which extends from the circuit breaker housing. The lever is operatively connected to a motor within the motor operator. The motor drives the lever, which, in turn, moves the operating handle to operate the circuit breaker. The operating handle is moved between "on", "off", and "reset" positions, depending on the rotational direction of the motor.

A plurality of buttons external to the motor operator controls electrical current to the motor. The rotational direction of the motor is changed depending on which of these buttons is selected by operating personnel. Thus, the operating personnel can select one button to place the operating handle in the "on" position, and another button to place the operating handle in the "off" or "reset" positions.

When the handle is moved to the "on" position, electrical contacts within the circuit breaker are brought into contact with each other, allowing electrical current to flow through the circuit breaker. When the handle is moved to the "off" position, the electrical contacts are separated, stopping the flow of electrical current through the circuit breaker. When the handle is moved to the "reset" position, an operating mechanism within the circuit breaker is reset, as is necessary after the operating mechanism has tripped in response to an overcurrent condition in the electrical circuit being protected by the circuit breaker.

In one example, a motor operator may be mounted to circuit breaker in a vertical orientation such as when the circuit breaker is mounted on a wall. Motor operators may be heavy and difficult for a single technician to mount on the breaker. For example, it is difficult at best for a single technician to hold the motor operator on the vertically mounted breaker while the technician is trying to install the fasteners that secure the motor operator to the breaker.

It would be advantageous to have a circuit breaker add on device, such as a motor operator, that is easily mounted to a circuit breaker.

BRIEF DESCRIPTION OF THE EMBODIMENTS

In accordance with one exemplary embodiment, a coupling between a motor operator and a circuit breaker includes a base plate of the motor operator having a top side and a bottom side, the base plate comprising an aperture, and a pin having a first end, the pin being captured within the aperture such that the first end of the pin protrudes through a first surface of the bottom side of the base plate, wherein the pin is further configured to engage the circuit breaker.

In accordance with another exemplary embodiment, a locking mechanism includes a pin assembly disposed at least partially within an aperture in a base plate of a circuit breaker accessory, the pin assembly including a pin having a first end and a second end, a spring disposed on the pin configured to bias the first end of the pin past a surface of the base plate, and a plate captured on the second end of the pin, the plate being configured to contact the base plate to effect movement of the pin and to retain at least a portion of the pin within the aperture, the locking mechanism also including a plate disposed within a housing of a circuit breaker, the plate including an aperture configured to accept the first end of the pin; wherein an engagement between the first end of the pin and the aperture couples the circuit breaker accessory to the circuit breaker.

In accordance with still another exemplary embodiment, a method for coupling a circuit breaker accessory to a circuit breaker includes guiding a protrusion of a base plate of the circuit breaker accessory into a recess of a housing of the circuit breaker, aligning a pin of the base plate with an aperture of the housing, and moving a first end of the pin into the aperture.

BRIEF DESCRIPTION OF THE DRAWINGS

The following detailed description is made with reference to the accompanying drawings, in which.

DETAILED DESCRIPTION OF THE PREFERRED EMBODIMENTS

Figure 1:
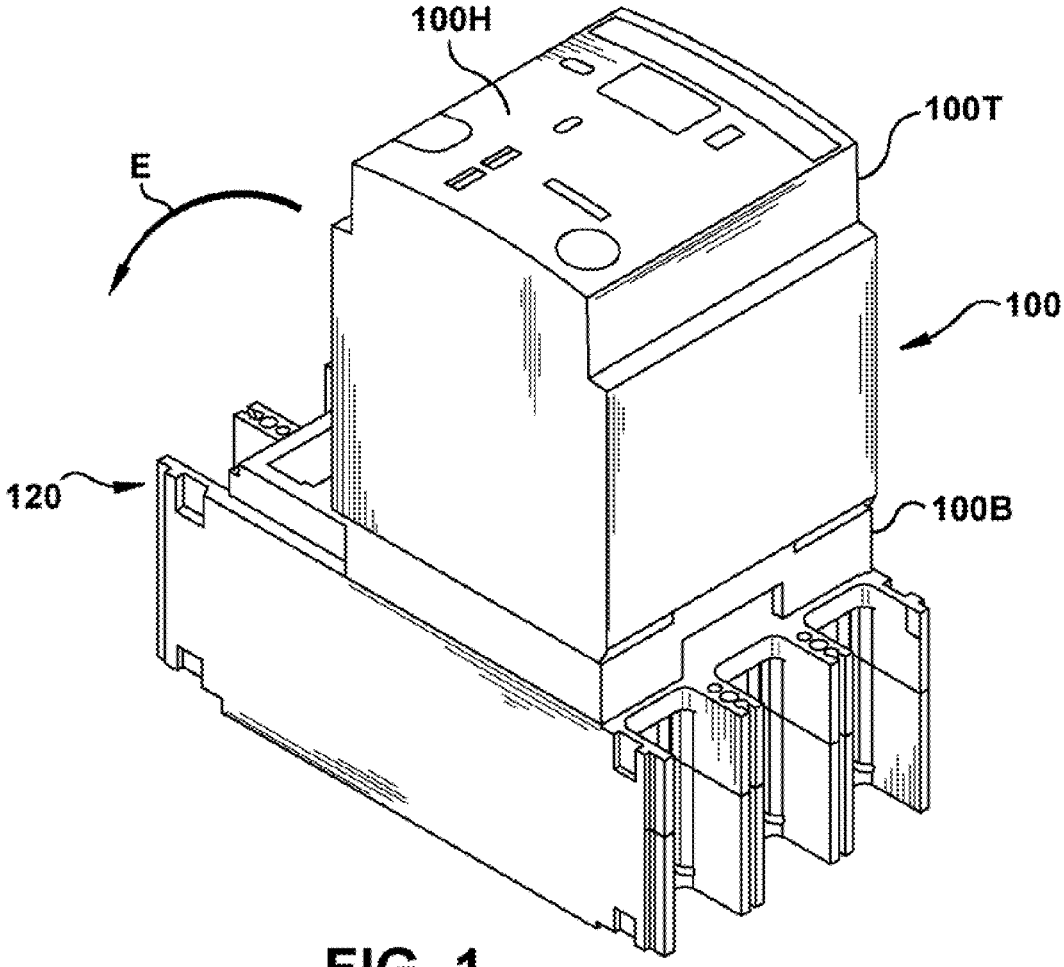
FIG. 1 is a schematic illustration of a motor operator mounted to a circuit breaker in accordance with an exemplary embodiment.

In one exemplary embodiment, referring to FIG. 1, a motor operator 100 is shown mounted to a circuit breaker 120. Although the embodiments disclosed will be described with reference to the drawings, it should be understood that the embodiments disclosed can be embodied in many alternate forms. In addition, any suitable size, shape or type of elements or materials could be used. It is also noted that while the exemplary embodiments are described herein with respect to motor operator 100, it should be understood that the exemplary embodiments may be equally applied to any suitable accessory device for circuit breakers.

The exemplary embodiments provide a user friendly motor operator design that allows for easy installation of the motor operator 100 to a circuit breaker 120 where the circuit breaker 120 and motor operator 100 are in a substantially vertical orientation, such as when mounted on a wall. In one example, the motor operator 100 and circuit breaker 120 include complimentary guiding features that allow a spring-biased pin 330 (FIG. 3A) of the motor operator 100 to engage a lock receiving aperture 200 (FIG. 2) of the circuit breaker as will be described in greater detail below. Engagement of the motor operator pin 330 with the lock receiving aperture 200 secures the motor operator 100 to the circuit breaker 120. As a result, one or more of the installer's hands may be free from holding the motor operator 100 on the circuit breaker 120, allowing the installer to complete the installation of the motor operator to the circuit breaker without fear of the motor operator falling away from or off of the circuit breaker.

In one exemplary embodiment, the motor operator 100 includes a base plate 100B and a top portion 100T. The top portion 100T includes a housing 100H and a motor operator frame (not shown). In one example, the motor operator frame may be part of or integral to a motor operator mechanism (not shown). In other examples, the motor operator frame may be configured so that the motor operator mechanism can be mounted to the frame. The motor operator mechanism and the motor operator frame are substantially housed within the housing 100H and the housing 100H is mounted to the motor operator frame in any suitable manner. The top portion 100T may be hingably mounted to the base plate 100B in any suitable manner, such as through the motor operator frame so that the top portion 100T is pivotable about the hinge in the direction of arrow E to allow access to motor operator mechanism and/or to allow mounting of the motor operator 100 to the circuit breaker 120.

The motor operator 100 may be mounted to the circuit breaker 120 in any suitable manner. For example, referring to FIGS. 2 and 3A the circuit breaker 120 and motor operator 100 may include complementary features that facilitate mounting the motor operator 100 to the circuit breaker 120. In one example, the circuit breaker 120 includes a housing 120H. The housing 120H includes a recess 220 through which the circuit breaker handle 210 protrudes. The recess 220 may have surfaces 220A, 220B, 220C. The circuit breaker housing 120H may also include a surface 230 that may be formed at an angle relative to surface 220A so as to form a wedge shaped interface between the surfaces 220A, 230. The surface 230 may include a lock receiving aperture 200 that allows a pin 330 of a locking mechanism (FIG. 4A-4C) to pass through the housing 120H into the lock receiving aperture 200. In another embodiment, the pin 330 may also pass through the housing and into an aperture 460 in plate 350P (FIGS. 4A, 4B) as will be described below. Referring briefly to FIG. 4B the plate 350P may be suitably mounted to, for example, the frame 350 of a circuit breaker trip unit mechanism 350M. In one example, the frame 350 includes side members 350L to which the plate 350P is fixedly secured. In other examples, a plate may be integrally formed in or affixed to the housing 120H where the plate includes an aperture for accepting the pin 330 in a manner substantially similar to that described herein with respect to plate 350P.

The motor operator base plate 100B may have a top side 400T and a bottom side 400B. The top portion 100T of the motor operator 100 may be hingably mounted to the top side 400T of the base plate 100B. The bottom side 400B of the base plate 100B contacts the circuit breaker housing 120H when the motor operator is mounted to the circuit breaker 120. The base plate 100B may include a protrusion 410 extending from the bottom side 400B of the base plate 10B. The protrusion 410 may be suitably configured such that the protrusion has a shape substantially complimentary to the recess 220 in the circuit breaker housing 120H. For example, the protrusion 410 may include surfaces 410A, 410B, 410C that are suitably shaped to substantially contact surfaces 220A, 220B, 220C of the recess 220 and allow the at least a portion of the bottom side 400B of the base plate 100B to substantially seat against the circuit breaker housing 120H for mounting the base plate 100B (and thus the motor operator 100) to the circuit breaker 120. Surface 410A may be configured to substantially contact surface 220A, surface 410B may be configured to substantially contact surface 220B and surface 410C may be configured to substantially contact surface 220C. It should be understood that in one example, the protrusion 410 is sized to that it may be slip fit into the recess 220. In other examples the fit between the protrusion 410 and recess 220 may be an interference fit.

The bottom side 400B of the base plate 100B may also include a surface 420 from which a portion of the pin 330 protrudes. The surface 420 may be formed at an angle with surface 410A so as to form a substantially wedge shaped interface between the surfaces 410A, 420. The surface 420 may also be substantially parallel with surface 230 of the circuit breaker housing 120H when the motor operator 100 is mounted to the circuit breaker 120. In one example, the surface 420 may substantially contact the surface 230 such that when the motor operator 100 is mounted on the circuit breaker 120 the protrusion 410 interacts with the recess 220 and/or the surface 420 interacts with surface 230 for guiding the base plate 100B onto the circuit breaker housing 120H for substantially aligning the pin 330 of the locking mechanism 300 (FIGS. 4A-4C) with the lock receiving aperture 200 as described in greater detail below. The top side 400T of the base plate 100B may include a surface 420 through which a portion of the pin 330 protrudes. The surface 420 may be substantially parallel with surface 420 located on the bottom side of the base plate 100B. In other examples, the surfaces through which the pin protrudes may have any suitable orientation relative to each other.

Referring also to FIGS. 4A-4D, the locking mechanism 300 will be described in greater detail. In one example, the locking mechanism 300 passes through an aperture 100A in the motor operator base plate 100B. The aperture may be a stepped aperture having a first diameter A and a second diameter B which is smaller than the first diameter A. The first diameter A opens through the bottom side 400B of the base plate 100B while the second diameter B opens through top side 400T of the base plate 100B. The transition between the first and second diameters A, B within the aperture 100A forms a step or shoulder 100S.

The locking mechanism 300 includes pin 330, spring 340, plate 310 and a locking device 320. In one example, the pin 330 is a step pin including at least a first diameter 330A adjacent a first end 330E1 of the pin 330 and a second diameter 330B adjacent a second end 330E2 of the pin 330. The first diameter 330A is suitably sized to fit within the first diameter A of aperture 100A. The second diameter 330B of the pin 330 is suitably sized to fit within the second diameter B of the aperture 100A. Suitable clearance exists between the pin 330 diameters 330A, 330B and the aperture 100A diameters A, B for allowing the pin 330 to move in the direction of arrow D within the aperture 100A. The transition between the first diameter 330A and the second diameter 330B of the pin 330 forms a step or shoulder 330S. In other examples, the pin may have any suitable configuration. The plate 310 may be a stepped plate having a base portion 310B and an extension portion 310E. In this example the bottom surface 435 of the extension portion 310E is offset from the bottom surface 430 of the base portion 310B so as to form step C. The base portion 310B also includes an aperture 310A through which the pin 330 passes. The diameter of the aperture 310A may be substantially the same diameter as the second diameter 330B of the pin. In one example, the aperture 310A may have a slip fit over the second diameter 330B of the pin 330 while in other examples, the fit between the aperture 310A and the second diameter 330B may be an interference fit.

Figure 3A:
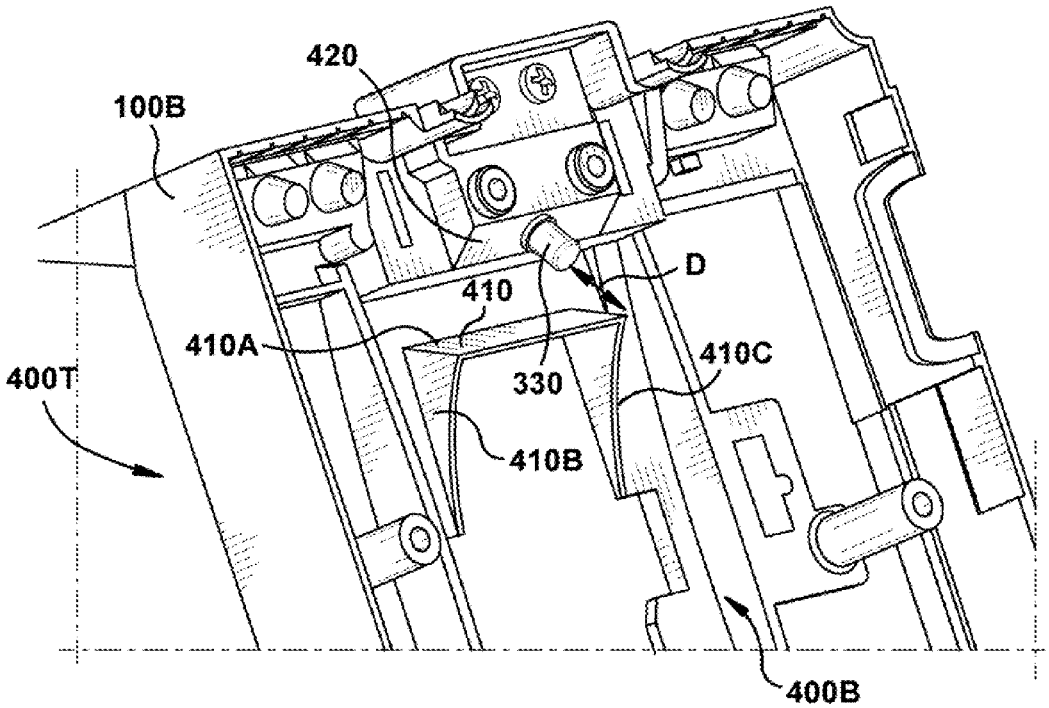
FIGS. 3A and 3B are respectively schematic illustrations of a bottom and top of a base of the motor operator of FIG. 1 in accordance with an exemplary embodiment.
Figure 4C:
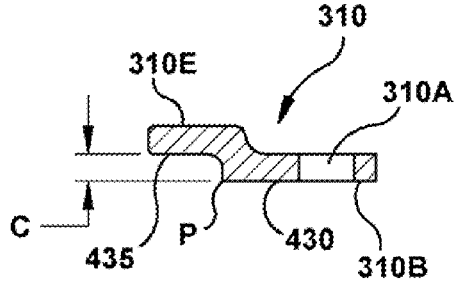
FIG. 4C is a sectional view of a portion of the motor operator in accordance with an exemplary embodiment.
Figure 4A:
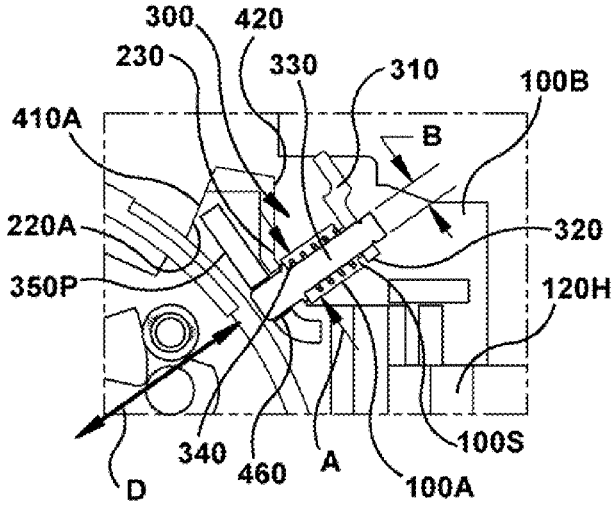
FIG. 4A is a sectional view of a portion of the motor operator and circuit breaker of FIG. 1 in accordance with an exemplary embodiment.
Figure 4D:
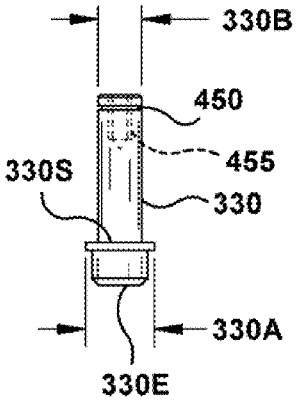
FIG. 4D is a schematic view of a portion of the motor operator in accordance with an exemplary embodiment.
Figure 4B:
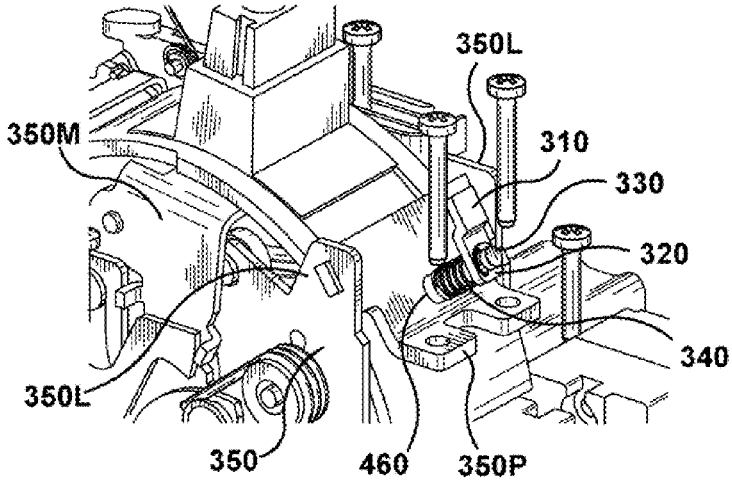
FIG. 4B is a partial schematic view of the motor operator and circuit breaker of FIG. 1 in accordance with an exemplary embodiment.

As can be seen best in FIG. 4A, the spring 340 is placed over the pin 330 and the pin is inserted into the aperture 100A so that the spring is sandwiched between the shoulder 100S of the aperture 100A and the shoulder 330S of the pin 330. The spring 340 is configured to bias the pin 330 so that the first end 330E1 of the pin 330 protrudes from the aperture 100A past surface 420 of the base plate 100B (see also FIG. 3A). The second end 330E2 of the pin protrudes through the second diameter B of the aperture so that the second end 330E2 extends past the surface 421 on the top side 400T of the base plate 100B. The plate 310 is placed onto the second end 330E2 of the pin 330 so that the second end passes at least partially through aperture 310A in the plate 310. A locking device 320 is affixed to the second end of the pin 330E2 for preventing the pin 330 from escaping the aperture 310A. The locking device 320 may be any suitable device such as, for example, a clip that engages a recess or groove 450 in the pin 330 or a fastener that engages threads 455 formed in (e.g. internal threads) or on (e.g. external threads) the pin 330. The locking device 320 may effect capturing the locking mechanism 300 in the base plate 100B. For example, because the locking device 320 prevents the pin 330 from escaping the aperture 310A, the biasing force of the spring 340 causes the bottom surface 430 of the base portion 310B of the plate 310 to contact surface 421 on the top side 400T of the base plate 100B for capturing the locking mechanism 300 within base plate 100B.

Figure 2:
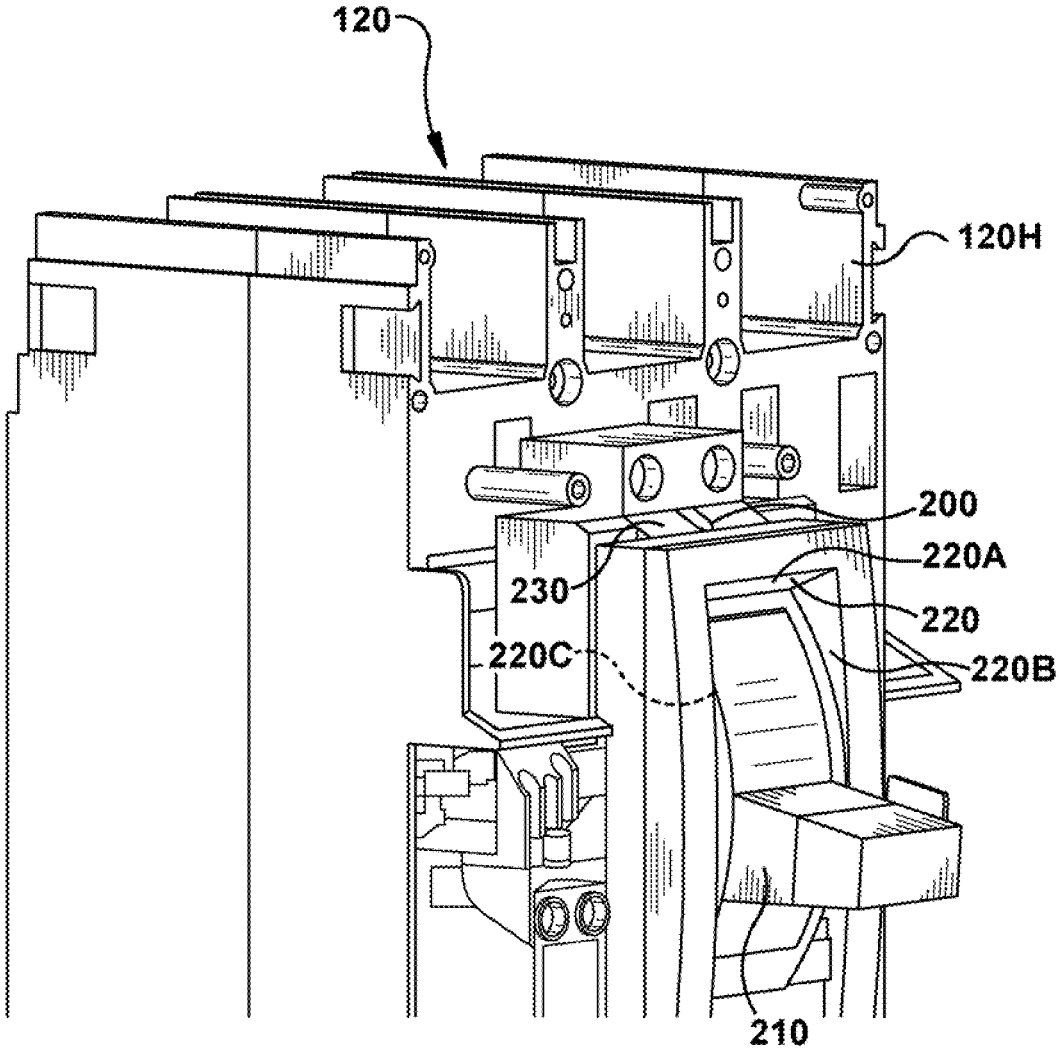
FIG. 2 is schematic illustration of a portion of the circuit breaker of FIG. 1 in accordance with an exemplary embodiment.

Referring to FIGS. 2, 3A and 4A, an exemplary installation of the motor operator 100 on the circuit breaker 120 will now be described. An installer places the motor operator base plate 100B against the housing 120H of the circuit breaker 120 so that the protrusion 410 of the base plate 100B is substantially inserted into the recess 220 of the circuit breaker 120. During placement of the base plate 100B on the circuit breaker, the surface 420 of the base plate 100B also substantially contacts the surface 230 of the housing 120H. As described above, the surfaces 410 and 420 and the surfaces 220, 230 are angled relative to each other so as to form mating wedges (as shown in FIG. 4A were one wedge fits in the other wedge). As the base plate is placed against the housing, the pin 330 contacts surface 230 such that the pin is forced into the aperture 100A. As the base plate 100B is substantially seated against the housing, the protrusion 410, recess 220 and/or surfaces 420, 230 guide placement of the base plate 100B so that the first end 33E of the pin is substantially aligned with the lock receiving aperture 200. The spring 340 forces the first end 330E of the pin 330 into the lock receiving aperture 200 and into the aperture 460 of plate 350P. The pin 330, when located within the lock receiving aperture 200, secures the motor operator 100 from falling away from the circuit breaker while at least a portion of the wedge shape interfaces formed by one or more of the surfaces 410, 420 and 220, 230 in conjunction with the pin 300 being engaged in the apertures 200, 460 substantially prevents the pin 330 from being lifted out of the lock receiving aperture 200. As the locking mechanism 300 secures the motor operator from falling away from or being lifted off of the circuit breaker, one or more of the installer's hands are free to secure the motor operator 100 to the circuit breaker 120 using any suitable fasteners and any necessary tools.

Figure 3B:
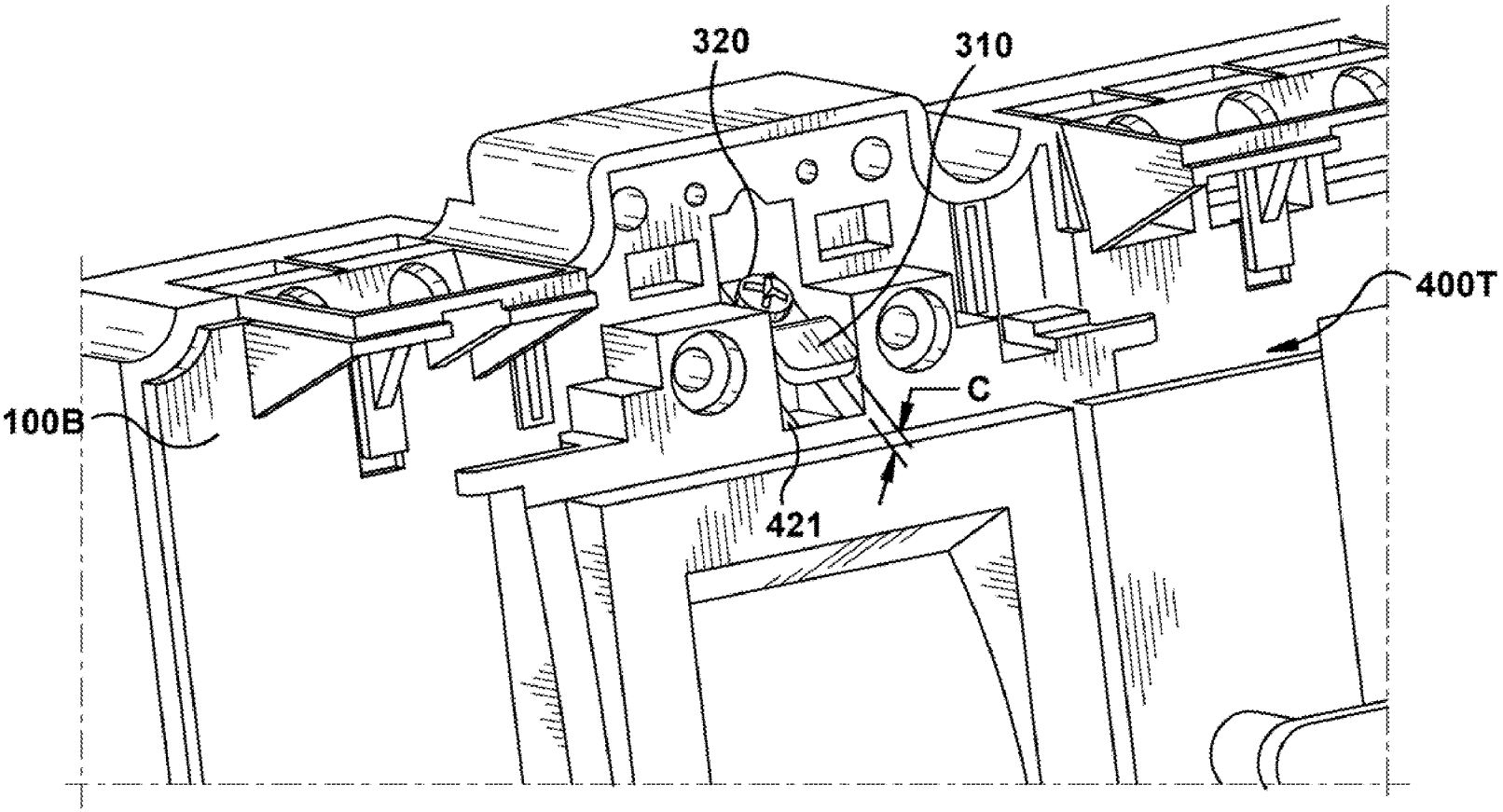

Referring also to FIG. 3B the locking mechanism is also configured to allow easy removal of the motor operator 100 from the circuit breaker 120. The installer may use one or more hands to remove the fasteners securing the motor operator 100 to the circuit breaker 120. The installer may then release the locking mechanism 300 by lifting or otherwise removing the pin 330 from the apertures 200, 460. In one example, the pin 330 may be removed from the apertures 200, 460 by placing an object between the surface 421 of the base plate 100B and the bottom surface 435 of the plate extension 310E for effectively pulling the pin 330 out of the apertures 200, 460. In another example, the locking mechanism 300 may be configured so that the installer presses the plate extension 310E towards the surface 421 so the plate 310 acts as a cam (e.g. pivoting about point P in FIG. 4C) for removing the pin 330 from the apertures 200, 460. In other examples, the pin 330 may be removed from the aperture 200, 460 in any suitable manner.

While exemplary embodiments have been described in connection with what are presently considered to be the most practical and preferred embodiments, it is to be understood that the embodiments are not limited to those disclosed herein. Rather, the embodiments described are intended to cover all of the various modifications and equivalent arrangements included within the spirit and scope of the appended claims.

What is claimed is:

1. A coupling to couple a motor operator and a circuit breaker, the coupling comprising:

a base plate a bottom side disposed to operably contact the circuit breaker, the base plate comprising an aperture defined therethrough; and a pin having a first end configured to engage the circuit breaker, the pin being captured within the aperture such that the first end of the pin protrudes through a first surface of the bottom side of the base plate; wherein a spring is disposed within the base plate aperture to bias the pin.

2. The coupling of claim 1, wherein the pin has a second end, the coupling further comprising a plate captured on the second end of the pin, the plate configured to provide movement of the pin within the aperture.

3. The coupling of claim 2, wherein the plate is captured on the second end of the pin with a fastener engaged to the pin.

4. The coupling of claim 2, wherein the plate is a stepped plate having a base portion and an extension portion, the base portion being configured to contact the base plate such the extension portion is raised away from the base plate to allow for insertion of an object between the base plate and the extension portion.

5. The coupling of claim 1, wherein the pin comprises a first shoulder and the aperture comprises a second shoulder, the spring being configured to fit between the first and second shoulders for biasing the pin.

6. The coupling of claim 1, wherein the base plate further comprises a protrusion extending from the bottom side.

7. The coupling of claim 6, wherein the protrusion is configured to mate with a recess in a housing of the circuit breaker, the recess being formed adjacent to a handle of the circuit breaker.

8. The coupling of claim 7, wherein:

the protrusion includes a second surface, the first surface being formed at an angle relative to the second surface so as to form a first substantially wedge shaped interface;

the recess includes a third surface, the third surface being formed at an angle relative to a fourth surface formed in the circuit breaker housing, so as to form a second substantially wedge shaped interface; and wherein at least a portion of the second substantially wedge shaped interface is configured to interact with a corresponding portion of the first substantially wedge shaped interface for guiding the base plate onto the circuit breaker housing.

9. The coupling of claim 7, wherein the recess and the protrusion are configured to guide the base plate onto the circuit breaker housing such that the pin is substantially aligned with an aperture disposed on the circuit breaker housing, and the spring being configured to direct the first end of the pin into the aperture upon alignment of the pin with the aperture.

10. A locking mechanism comprising:

a pin assembly disposed at least partially within an aperture defined in a bottom side of a base plate of a circuit breaker accessory, the base plate bottom side disposed to operably contact the circuit breaker, the pin assembly including, a pin having a first end and a second end, a spring disposed on the pin configured to bias the first end of the pin past a bottom surface of the base plate bottom side, and a plate captured on the second end of the pin, the plate being configured to contact the base plate to effect movement of the pin and to retain at least a portion of the pin within the aperture;

a plate disposed within a housing of a circuit breaker, the plate including an aperture configured to accept the first end of the pin; and wherein an engagement between the first end of the pin and the aperture couples the circuit breaker accessory to the circuit breaker.

11. The locking mechanism of claim 10, wherein the plate captured on the second end of the pin is a stepped plate having a base portion and an extension portion, a bottom of the base portion being configured to contact the base plate such that a bottom of the extension portion is raised away from the base plate to allow for insertion of an object between the base plate and the extension portion.

12. The locking mechanism of claim 10, wherein the plate disposed in the housing of the circuit breaker is coupled to a trip unit mechanism of the circuit breaker.

13. The locking mechanism of claim 10, wherein the plate is captured on the second end of the pin with a fastener that is engaged to pin.

14. The locking mechanism of claim 10, wherein the pin comprises a first shoulder, and the aperture comprises a second shoulder, the spring being fit between the first and second shoulders for biasing the pin.

* * * * *